US012534965B2

(12) United States Patent
Harvey et al.

(10) Patent No.: US 12,534,965 B2
(45) **Date of Patent: *Jan. 27, 2026**

(54) SYSTEM, METHOD AND APPARATUS FOR HYDRAULIC DOWNHOLE STICK-SLIP MITIGATION

(71) Applicant: General Downhole Tools, Ltd., Calgary (CA)

(72) Inventors: Michael Harvey, Calgary (CA); Jovan Vracar, Calgary (CA); David Devlin, Calgary (CA)

(73) Assignee: GENERAL DOWNHOLE TOOLS, LTD., Calgary (CA)

( * ) Notice: Subject to any disclaimer, the term of this patent is extended or adjusted under 35 U.S.C. 154(b) by 0 days.

This patent is subject to a terminal disclaimer.

(21) Appl. No.: 18/890,149

(22) Filed: Sep. 19, 2024

(65) Prior Publication Data

US 2025/0067129 A1 Feb. 27, 2025

Related U.S. Application Data

(63) Continuation of application No. 18/100,068, filed on Jan. 23, 2023, now Pat. No. 12,104,442.

(60) Provisional application No. 63/303,397, filed on Jan. 26, 2022.

(51) Int. Cl.
*E21B 17/06* (2006.01)

(52) U.S. Cl.
CPC ..... *E21B 17/06* (2013.01)

(58) Field of Classification Search
CPC ..... E21B 17/06
USPC ..... 175/321
See application file for complete search history.

(56) References Cited

U.S. PATENT DOCUMENTS

| | | | |
|---|---|---|---|
| 4,281,726 | A | 8/1981 | Garrett |
| 6,308,940 | B1 | 10/2001 | Anderson |
| 10,982,492 | B1 | 4/2021 | Gopalan |
| 2013/0168092 | A1 | 7/2013 | Evans |
| 2015/0376959 | A1 | 12/2015 | Dinica et al. |
| 2016/0230479 | A1 | 8/2016 | Khaparde et al. |
| 2017/0145759 | A1 | 5/2017 | Johnson |
| 2017/0204684 | A1 | 7/2017 | Cravatte et al. |
| 2018/0171726 | A1 | 6/2018 | Donald et al. |

*Primary Examiner* — Taras P Bemko
(74) *Attorney, Agent, or Firm* — Dickinson Wright PLLC

(57) ABSTRACT

A downhole tool includes an outer, intermediate and inner tubular bodies. The intermediate tubular body has vanes and female splines. The inner tubular body in the intermediate tubular body includes a load nut and male splines that rotationally couple with the female splines to allow relative axial movement between the inner tubular body and the intermediate tubular body. The male and female splines can rotate inside the outer tubular body for an angle determined by movement of the vanes between longitudinal ribs in the outer tubular body. The inner tubular body has an extended position. When weight is applied on the drill bit (WOB), the inner tubular body has a retracted position where it is pushed inward to compress springs. This causes the inner tubular body and the intermediate tubular body to rotate for a selected angle relative to the outer tubular body.

22 Claims, 6 Drawing Sheets

SYSTEM, METHOD AND APPARATUS FOR HYDRAULIC DOWNHOLE STICK-SLIP MITIGATION

This patent application is a continuation of and claims priority to and the benefit of U.S. patent application Ser. No. 18/100,068, filed Jan. 23, 2023, which claims priority to and the benefit of U.S. Prov. Pat. App. No. 63/303,397, filed Jan. 26, 2022, each of which is incorporated herein by reference in its entirety.

TECHNICAL FIELD

The present disclosure relates generally to downhole tools used in well drilling and, in particular, to a system, method and apparatus for a hydraulic downhole stick-slip mitigation.

BACKGROUND

Conventional techniques for performing drilling operations in an oil or gas well include deploying a drill string with a cutting element, or drill bit, into a wellbore. The drill string or bottom hole assembly (BHA) may contain a variety of components including tools suitable for performing various functions related to the drilling operation. Downhole tools may include one or more dampening elements for reducing torsional shock or excessive vibration of the drill string and drill bit. Such equipment can reduce or eliminate sticking and jerking of the drill bit or drill string and associated damage. Although there are conventional solutions to address these issues, improvements in dampening components continue to be of interest.

SUMMARY

Embodiments of a system, method and apparatus for hydraulic downhole stick-slip mitigation are disclosed. For example, a downhole tool for a drill string with a drill bit in a hydrocarbon well can include an outer tubular body having an axis, a spring cavity with disc springs, longitudinal ribs, a top end plate with a top port, a vane cavity and a bottom end plate with a bottom port. The top and bottom ports can provide hydraulic fluid flow to and from the vane cavity. An intermediate tubular body is in the outer tubular body and includes vanes located in the vane cavity of the outer tubular body, and female splines. The vanes have a vane port. An inner tubular body is in the intermediate tubular body and includes a load nut and male splines that rotationally couple with the female splines and allow relative axial movement between the inner tubular body and the intermediate tubular body. The male and female splines can rotate inside the outer tubular body for an angle determined by movement of the vanes between the longitudinal ribs in the outer tubular body. The inner tubular body has an extended position where it is pushed by the disc springs acting on the load nut. When weight is applied on the drill bit (WOB), the inner tubular body has a retracted position where it is pushed inward to compress the disc springs and push hydraulic fluid through the vane port on one side of the vanes in the vane cavity. This causes the inner tubular body and the intermediate tubular body to rotate for a selected angle relative to the outer tubular body.

BRIEF DESCRIPTION OF THE DRAWINGS

So that the manner in which the features and advantages of the embodiments are attained and can be understood in more detail, a more particular description can be had by reference to the embodiments that are illustrated in the appended drawings. However, the drawings illustrate only some embodiments and are not to be considered limiting in scope since there can be other equally effective embodiments.

It shall be noted that some of the details and/or features shown in the drawings herein may not be drawn to scale for clarity purposes.

The use of the same reference symbols in different drawings indicates similar or identical items.

DETAILED DESCRIPTION

The following discussion is directed to various embodiments of the present disclosure. Although one or more of these embodiments may be preferred, the embodiments disclosed should not be interpreted, or otherwise used, as limiting the scope of the disclosure, including the claims. In addition, one skilled in the art will understand that the following description has broad application, and the discussion of any embodiment is meant only to be exemplary of that embodiment, and not intended to imply that the scope of the disclosure, including the claims, is limited to that embodiment. Accordingly, various modifications and additions can be made to the exemplary embodiments discussed without departing from the scope of the present disclosure. For example, while the embodiments described below refer to particular features, the scope of this disclosure also includes embodiments having different combinations of features and embodiments that may not include all of the below described features.

In general, the present disclosure describes a downhole tool and methods of using a downhole tool for dampening torsional shock and vibration while drilling. The apparatus is for use as part of a drill string within a well. The downhole tool has an outer tubular body with two or more longitudinal cavities defined by longitudinal ribs and end plates, an intermediate tubular body with two or more vanes that fit into the cavities of the outer body, and an inner cylindrical body positioned at least partially within the outer and intermediate bodies. The intermediate and inner bodies can be rotationally coupled with splines. Fluid cavities (e.g., chambers) formed by the outer, intermediate and inner bodies contain fluid. Depending on the weight on bit (WOB) and/or torque on the bit, the fluid can push the inner body against the springs located in the upper part of the outer body. Depending on valve configurations in the end plates, movement of the inner body may be rotationally and axially coupled with the intermediate body. Thus, WOB alone or torque alone can cause axial and rotational movement of the inner body. If uncoupled, WOB can cause only axial movement of the inner body, and torque rotational movement and additional axial movement.

Figure 1:
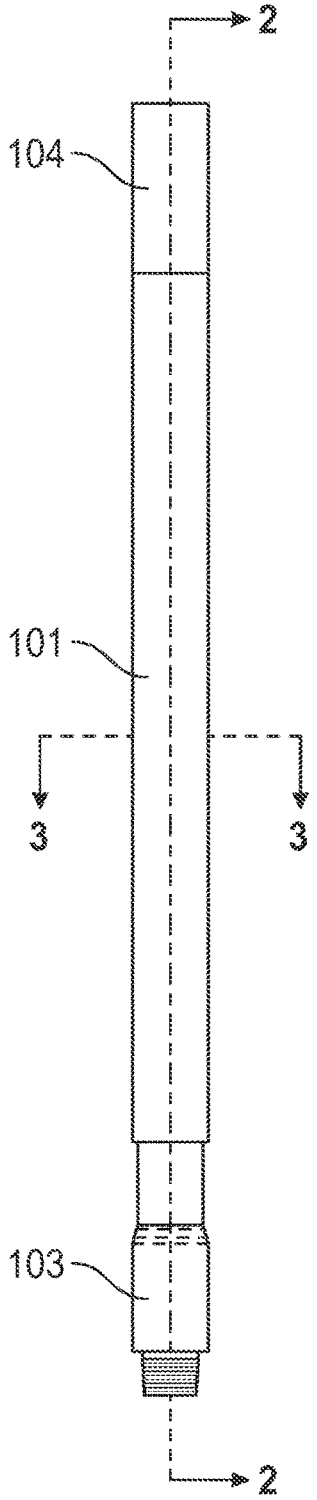
FIG. 1 is a side view of an embodiment of a tool in an extended position, with no axial load and no torque on the drill bit.
Figure 2:
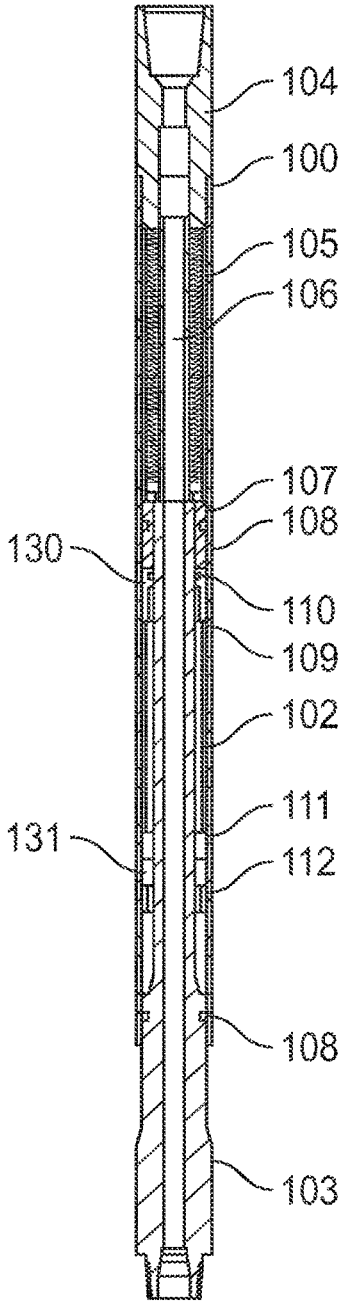
FIG. 2 is a sectional side view of the tool of FIG. 1, taken along the line 2-2 of FIG. 1.
Figure 8:
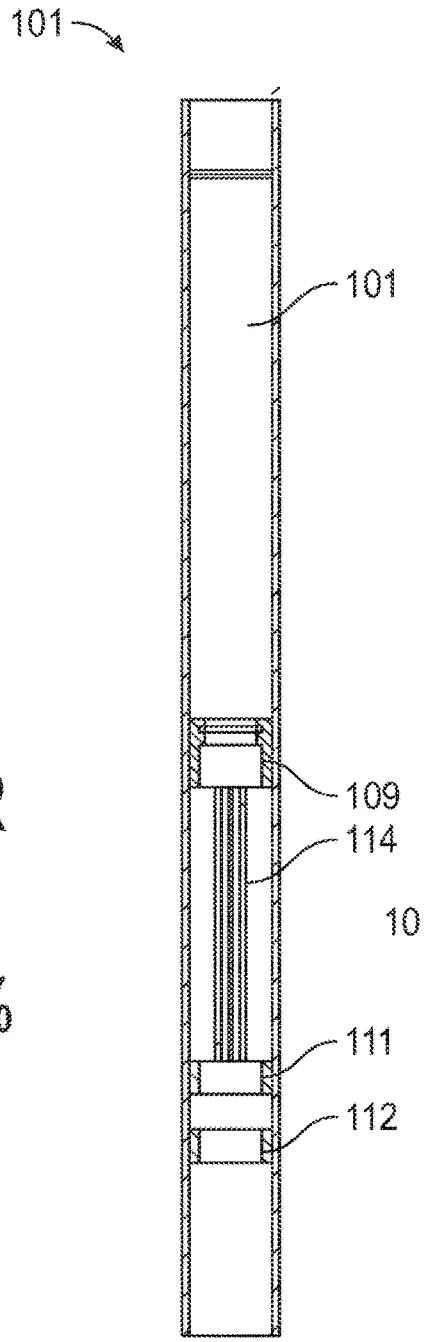
FIG. 8 is a sectional side view of the outer tubular body of FIG. 7, taken along the line 8-8 of FIG. 7.
Figure 9:
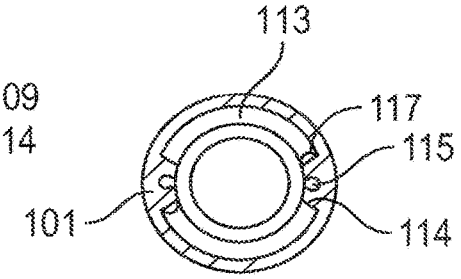
FIG. 9 is a sectional end view of the outer tubular body of FIG. 7, taken along the line 9-9 of FIG. 7.
Figure 10:
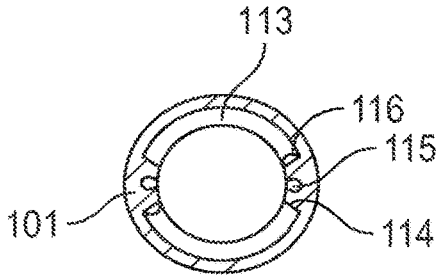
FIG. 10 is a sectional end view of the outer tubular body of FIG. 7, taken along the line 10-10 of FIG. 7.
Figure 11:
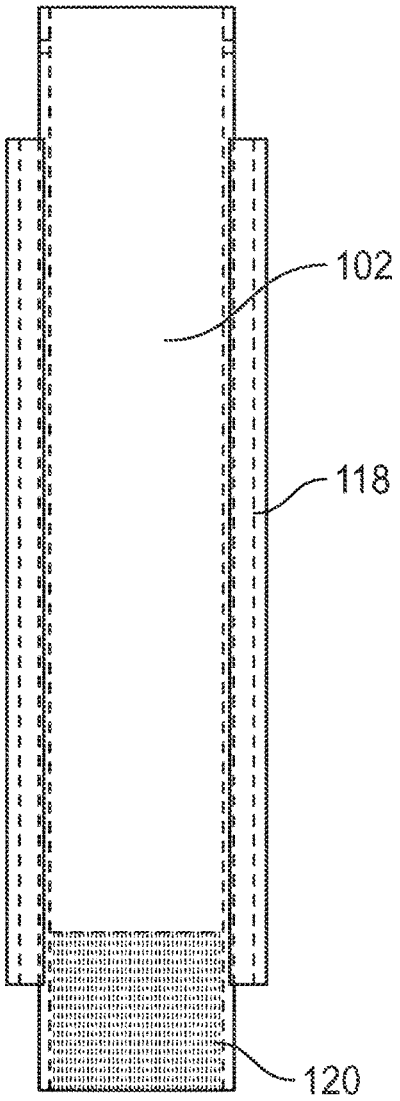
FIGS. 11-13 are front, side and end views, respectively, of an embodiment of an intermediate tubular body of a tool.
Figure 12:
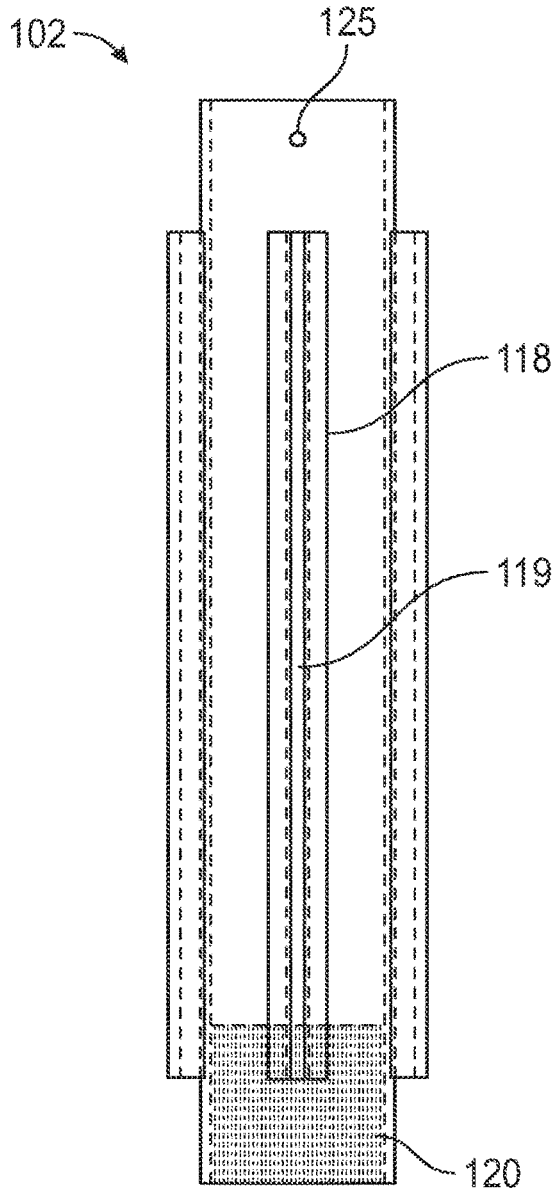
Figure 13:
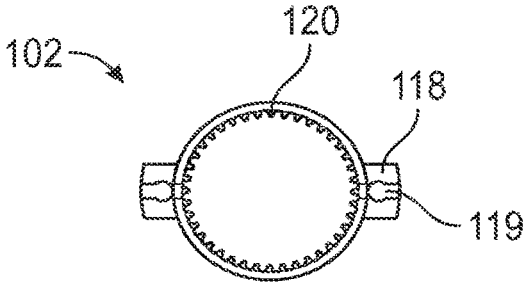
Figure 14:
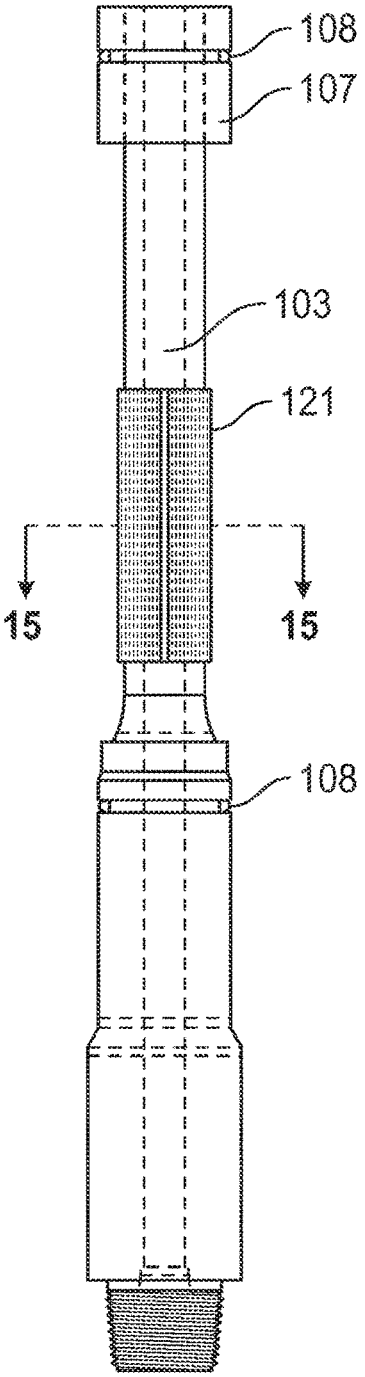
FIG. 14 is a side view of an embodiment of an inner cylindrical body of a tool.
Figure 15:
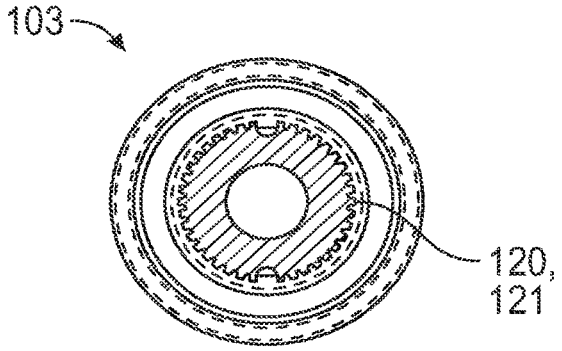
FIG. 15 is a sectional end view of the inner body of FIG. 14, taken along the line 15-15 of FIG. 14.
Figure 16:
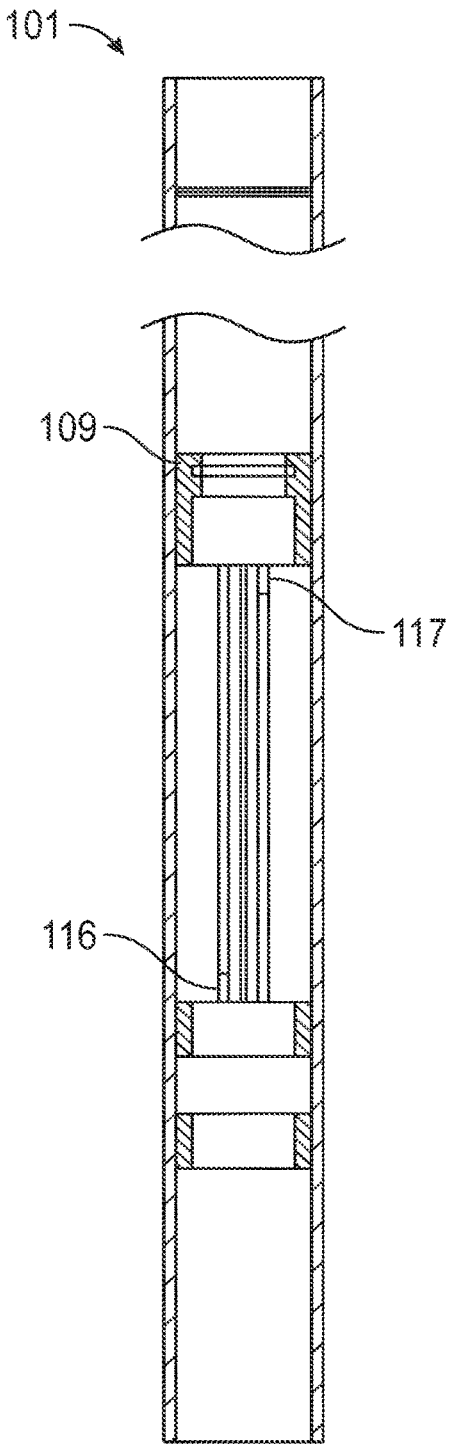
FIGS. 16 and 17 are sectional side views of an embodiment of the outer tubular body of a tool; the embodiment of FIG. 16 shows coupled axial and rotational movement of the inner tubular body of a tool; and the embodiment of FIG. 17 shows uncoupled axial and rotational movement of the inner tubular body of the tool.
Figure 17:
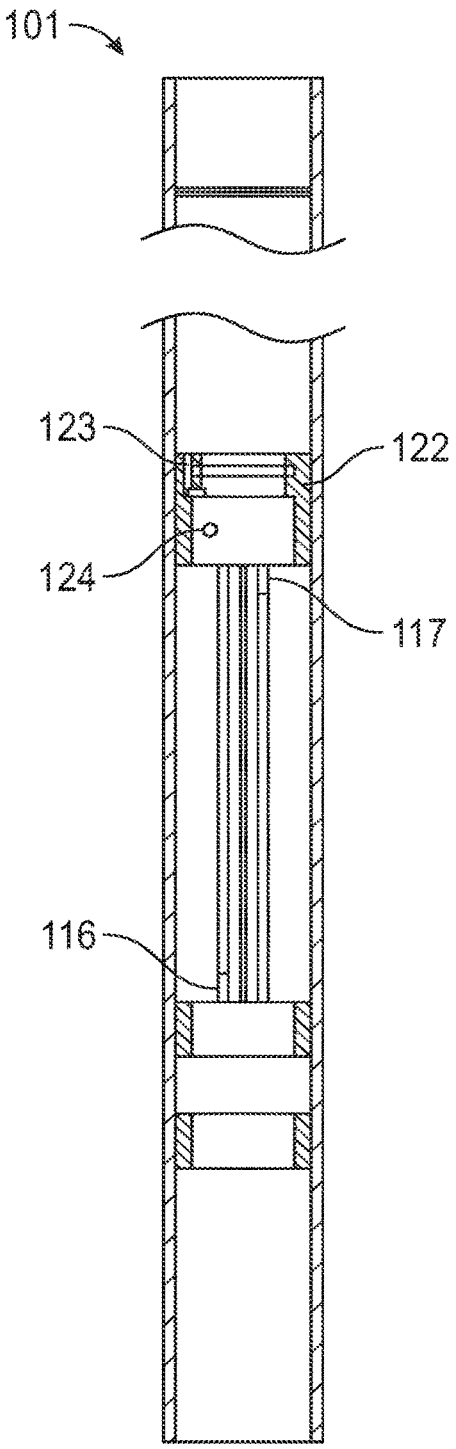

For example, referring to FIGS. 1-17, embodiments of a downhole tool for a hydrocarbon well can include an outer tubular body 101 can include two or more longitudinal ribs 114 (FIGS. 8-10), a top end plate 109 and a bottom end plate 111. The longitudinal ribs 114 can include rib seals 115 to seal against the cylindrical section of an intermediate tubular body 102 (FIGS. 2-3).

Figure 3:
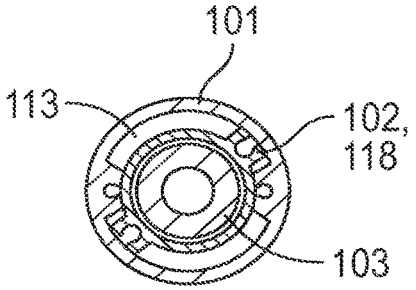
FIG. 3 is a sectional end view of the tool of FIG. 1, taken along the line 3-3 of FIG. 1.
Figure 4:
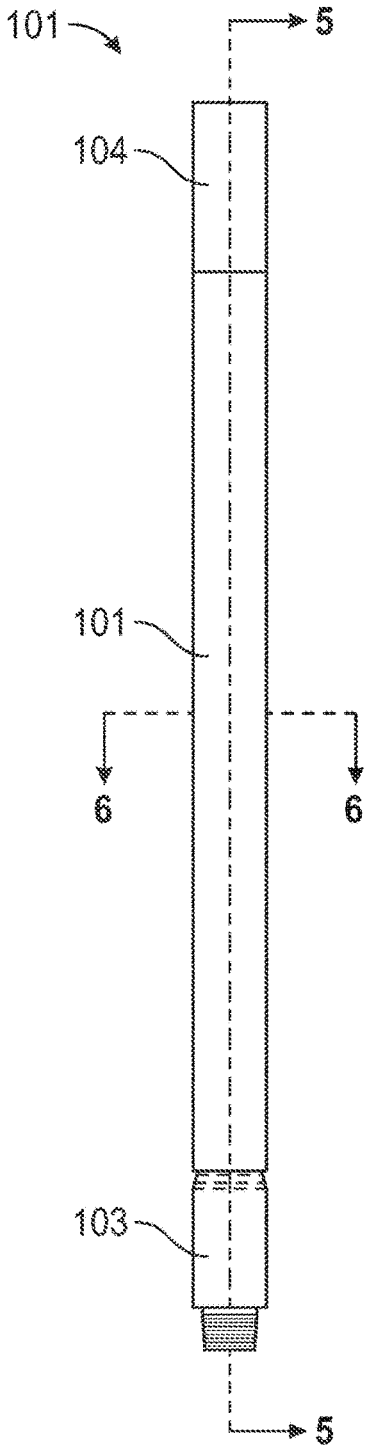
FIG. 4 is a side view of an embodiment of the tool in a fully retracted position; the retracted position can depend on axial load on and/or torque applied to the drill bit.
Figure 5:
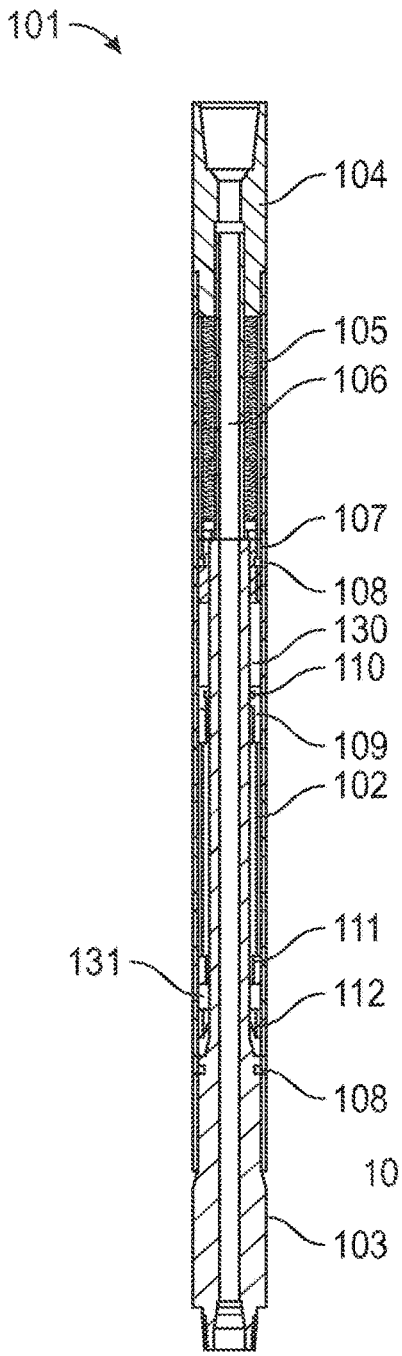
FIG. 5 is a sectional side view of the tool of FIG. 4, taken along the line 5-5 of FIG. 4.
Figure 6:
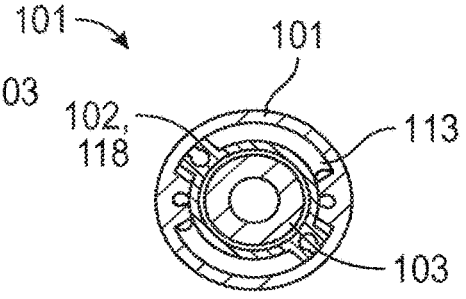
FIG. 6 is a sectional end view of the tool of FIG. 4, taken along the line 6-6 of FIG. 4.
Figure 7:
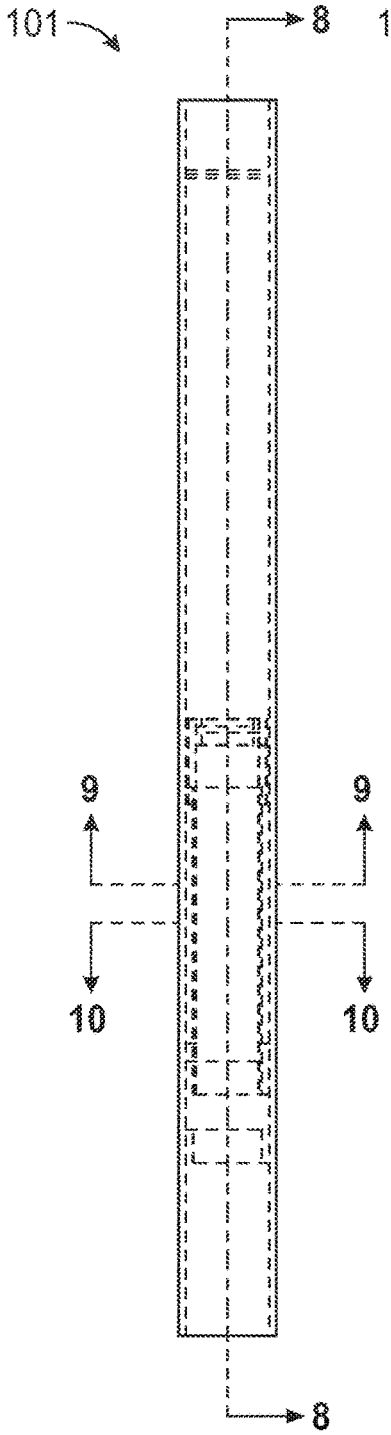
FIG. 7 is a side view of an embodiment of an outer tubular body of a tool.

In addition, the outer tubular body 101 can have two or more vane cavities 113 (FIG. 3). The top end plate 109 and the bottom end plate 111 can have top and bottom ports 117, 116 (FIGS. 9-10), respectively, to provide hydraulic oil flow to and from the vane cavities 113. A stop ring 112 (FIGS. 2 and 5) can be located below the bottom end plate 111 to limit upward movement of an inner tubular body 103. Above the top end plate 109, the outer tubular body 101 can include a spring cavity to accommodate springs, such as disc springs 105. The outer tubular body 101 also can have a threaded connection 100 adjacent to its upper end to connect to a crossover sub 104. The crossover sub 104 can connect the tool to an upper portion of the drill string.

Embodiments of the intermediate tubular body 102 can include two or more vanes 118 (FIGS. 3, 6 and 11-13) that are accommodated in the vane cavities 113 of the outer tubular body 101. The vanes 118 can includes seals 119 to seal against the outer tubular body 101 and the top and bottom end plates 109, 111. The intermediate tubular body 102 can include female splines 120 to engage with male splines 121 (FIGS. 14-15) on the inner tubular body 103. The splines 120, 121 can allow relative axial movement between the intermediate tubular body 102 and the inner tubular body 103, while they are rotationally coupled. Axial movement of the intermediate tubular body 102 relative to the outer tubular body 101 can be restricted by the top and bottom end plates 109, 111, while relative rotational movement therebetween can be determined by the rotational movement of the vanes 118 within the vane cavities 113.

Versions of the inner tubular body 103 can include connection to the drill string below. The inner tubular body 103 can act as a piston and include one or more seals 108 (see FIGS. 2 and 14; e.g., two shown) to seal against the outer tubular body 101. The male spline 121 can be included further up on the inner tubular body 103. A load nut 107 with one or more seals 108 can be attached adjacent to the top of the inner tubular body 103. The load nut 107 can act as a piston with the inner tubular body 103. An extension 106 (FIGS. 2 and 5) of the inner tubular body 103 can act as a spring guide and conduit for the mud flow.

Examples of the outer tubular body 101 and the inner tubular body 103 can include upper and lower hydraulic chambers 130, 131. The upper chamber 130 can be between the top end plate 109 and the load nut 107. The lower chamber 131 can be below the bottom end plate 111. A seal 110 can be located between the inner tubular body 103 and the intermediate tubular body 102. The seal 110 can prevent direct oil flow between the upper and lower chambers 130, 131, and can force oil flow between the upper and lower chambers 130, 131 to occur only through the vane cavities 113. The inner tubular body 103 can be rotationally coupled with the intermediate tubular body 102 via the splines 120, 121. The splines 120, 121 can rotate inside the outer tubular body 101 for an angle determined by movement of the vanes 118 between the longitudinal ribs 114 in the outer tubular body 101.

Embodiments of the inner tubular body 103 can travel axially up and down through the intermediate tubular body 102. Upward travel of the inner tubular body 103 can be limited by the stop ring 112, and its downward travel can be limited by the top end plate 109.

At least some embodiments of the inner tubular body 103 can be pushed to an extended position by the disc springs 105 acting on the load nut 107. When weight is applied on the drill bit (or weight on bit, WOB), the inner tubular body 103 can be pushed upwards, thereby compressing the disc springs 105 (FIG. 5) and pushing hydraulic oil through the bottom port 116 (FIG. 10) on one side of the vanes 118 in the vane cavities 113). This can cause the inner tubular body 103 and the intermediate tubular body 102 to rotate for a selected angle relative to the outer tubular body 101. Such rotational movement also can push hydraulic oil from the other side of the vanes 118 through the top port 117 (FIG. 9) to the upper chamber 130 (FIGS. 2 and 5) between the top end plate 109 and the load nut 107. Applying torque on the drill bit, further rotational movement of the inner tubular body 103 and the intermediate tubular body 102 can occur. At the same time, more oil can be pumped to the upper chamber 130 between the top end plate 109 and the load nut 107, thereby moving the inner tubular body 103 axially upward and further compressing the disc springs 105. When decreasing WOB and/or torque on the drill bit, the process can occur in the opposite direction as fluid flows to the lower chamber 131.

To increase flexibility of an embodiment of the tool for different well conditions, axial movement of the inner tubular body 103 may be uncoupled from rotational movement when WOB is applied. In one version, another embodiment of a top end plate 122 (FIG. 17; which can be used instead of the top end plate 109, in an alternate embodiment) can be equipped with a check valve 123 (which has a bypass port) and a return port 124. When the return port 124 in the top end plate 122 is aligned with a port 125 (FIG. 12) in the intermediate tubular body 102, the return port 124 can open in response to the position of the vanes 118 of the intermediate tubular body 102. Some examples of the inner tubular body 103 can move axially, without rotation, when only WOB is applied. In other embodiments, the inner tubular body 103 can rotate and move axially when torque on the drill bit is applied.

Embodiments of the outer tubular body 101 includes two or more longitudinal ribs 114, a top end plate 109 and bottom end plate 111 that define one or more vane cavities 113 in the outer tubular body 101. The longitudinal ribs 114 include rib seals 115 to seal against the outer cylindrical surface of the intermediate tubular body 102. The top and bottom end plates 109, 111 have ports 117 and 116 that provide hydraulic oil flow from and to the vane cavities 113. Below the bottom end plate 111, a stop ring 112 can limit upward movement of the inner tubular body 102. Above the top end plate 109, the outer tubular body 101 has a cavity to accommodate disc springs 105 and, on the very top, a threaded connection to connect to a crossover sub 104. The crossover sub 104 can connect the tool to the upper portion of the drill string.

Versions of the intermediate tubular body 102 can include two or more vanes 118 that can fit into the vane cavities 113 of the outer tubular body 101, which provides the vane cavities 113 with separate volumes. The vanes 118 can include seals 119 to seal against the outer tubular body 101 and the top and bottom end plates 109, 111. The intermediate tubular body 102 can include female splines 120 to engage to the male splines 121 of the inner tubular body 103, thereby allowing axial relative movement between the intermediate tubular body 102 and inner tubular body 103, while they are rotationally coupled together. Axial movement of the intermediate tubular body 102 relative to the outer tubular body 101 can be restricted by the top and bottom end plates 109, 111, respectively, while rotational movement can be limited by rotational movement of the vanes 118 within the vane cavities 113.

Embodiments of the inner tubular body 103 can include connection to a lower portion of the drill string. For example, a piston portion of the inner tubular body 103 can have one or more seals 108 to seal against the outer tubular body 101. Further up the tool, male splines 121 can be on the inner tubular body 103. Adjacent the top of the inner tubular body 103, a load nut 107 can be attached and include one or more seals 108. In this way, the inner tubular body 103 can act as a piston. In addition, the inner tubular body extension 106 can act as a spring guide and conduit for the mud that flows through the tool.

In some examples, the outer and inner tubular bodies 101, 103 can form hydraulic chambers, with a lower chamber 131 located below the bottom end plate 111, and an upper chamber 130 between the top end plate 109 and the load nut 107. The inner tubular body 103 can be rotationally coupled with the intermediate tubular body 102 by the splines 120, 121, such that they rotate inside the outer tubular body 101 for an angle of movement of the vanes 118 between the longitudinal ribs 114 of the outer tubular body 101.

Embodiments of the inner tubular body 103 can travel axially up and down through the intermediate tubular body 102. Upward travel of the inner tubular body 103 can be limited by the stop ring 112, and downward travel of the inner tubular body 103 can be limited by the top end plate 109.

Versions of the inner tubular body 103 can be pushed to an extended position by a set of springs, such as disc springs 105, which can act on the load nut 107. Applying weight on the drilling bit (WOB) pushes the inner tubular body 103 upward. This can compress the disc springs 105 and push hydraulic oil through one or more ports 116 on one side of the vanes 118 in the vane cavities 113. In turn, this can cause inner tubular body 103 and the intermediate tubular body 102 to rotate for a selected angle relative to the outer tubular body 101. Such motion also can push hydraulic oil from another side of the vanes 118 through one or more ports 117 to an upper chamber 130 between the top end plate 109 and the load nut 107. Applying torque on the drill bit, further rotational movement of the inner tubular body 103 and intermediate tubular body 102 can occur and more oil can be pumped to the upper chamber 130 between the top end plate 109 and the load nut 107, which can move inner tubular body 103 axially upward and further compress the disc springs 105. Decreasing WOB and/or torque on the drill bit, the process can occur in the opposite direction. The disc springs 105 can be located in the upper part of the outer tubular body 101 and can be separated and sealed from the upper chamber 130 by the load nut 107.

In another embodiment of the tool, and to increase flexibility of the tool for different well conditions, axial movement of the inner tubular body 103 can be uncoupled from rotational movement when WOB is applied to the drill bit. In this embodiment, the top end plate 122 can be equipped with a bypass port in a check valve 123 and a return port 124. The return port 124 can open with a specific position of the vanes 118 of the intermediate tubular body 102, when the return port 124 is aligned with a return port 125 on the intermediate tubular body 102. In this embodiment, the inner tubular body 103 can move axially without rotation when only WOB is applied, and it can rotate and move axially when torque on the bit is applied.

PARTS LIST

101 outer tubular body
102 intermediate tubular body
103 inner tubular body
104 crossover sub
105 disc springs
106 extension of the inner tubular body 103
107 load nut
108 seal
109 top end plate
110 seal
111 bottom end plate
112 stop ring
113 vane cavities
114 longitudinal ribs
115 rib seals
116 port
117 port
118 vanes
119 seals
120 female splines
121 male splines
122 top end plate
123 check valve of bypass port
124 return port in the top end plate 122
125 return port in the intermediate tubular body 102
130 upper chamber between the top end plate 109 and the load nut 107
131 lower chamber Other embodiments can include one or more of the following items.

1. A downhole tool for a drill string with a drill bit in a hydrocarbon well, the downhole tool comprising:
   an outer tubular body having an axis, a spring cavity with disc springs, longitudinal ribs, a top end plate with a top port, a vane cavity and a bottom end plate with a bottom port, wherein the top and bottom ports provide hydraulic fluid flow to and from the vane cavity;
   an intermediate tubular body in the outer tubular body and comprising vanes located in the vane cavity of the outer tubular body, and female splines, and the vanes have a vane port;

an inner tubular body in the intermediate tubular body and comprising a load nut and male splines that rotationally couple with the female splines and allow relative axial movement between the inner tubular body and the intermediate tubular body, wherein the male and female splines can rotate inside the outer tubular body for an angle determined by movement of the vanes between the longitudinal ribs in the outer tubular body; and wherein the inner tubular body has an extended position where it is pushed by the disc springs acting on the load nut and, when weight is applied on the drill bit (WOB), the inner tubular body has a retracted position where it is pushed inward to compress the disc springs and push hydraulic fluid through the vane port on one side of the vanes in the vane cavity, which causes the inner tubular body and the intermediate tubular body to rotate for a selected angle relative to the outer tubular body.

2. The downhole tool wherein rotational movement of the inner and intermediate tubular bodies also pushes hydraulic fluid from another side of the vanes through the top port to an upper chamber between the top end plate and the load nut.
3. The downhole tool wherein, when torque is applied on the drill bit, further rotational movement of the inner tubular body and the intermediate tubular body can occur, such that more hydraulic fluid is pumped to the upper chamber between the top end plate and the load nut, thereby moving the inner tubular body axially upward and further compressing the disc springs.
4. The downhole tool wherein decreasing WOB or torque on the drill bit causes the downhole tool to operate in an opposite direction.
5. The downhole tool wherein the top end plate comprises a bypass port with a check valve and a return port wherein, when the return port is aligned with a port in the intermediate tubular body, the return port opens with a specific position of the vanes of the intermediate tubular body.
6. The downhole tool wherein the inner tubular body can move axially, without rotation, when only WOB is applied.
7. The downhole tool wherein the inner tubular body can rotate and move axially when torque is applied on the drill bit.
8. The downhole tool further comprising a stop ring mounted in the outer tubular body and located below the bottom end plate to limit upward axial movement of the inner tubular body.
9. The downhole tool wherein downward travel of the inner tubular body is limited by the top end plate.
10. The downhole tool wherein the outer tubular body comprises a threaded connection adjacent to an upper end thereof to connect to a crossover sub to connect with an upper portion of the drill string.
11. The downhole tool wherein the inner tubular body comprises a connection for coupling to a lower portion of the drill string.
12. The downhole tool wherein the longitudinal ribs have rib seals that engage the intermediate tubular body.
13. The downhole tool wherein the vanes have vane seals that seal against the outer tubular body and the top and bottom end plates.
14. The downhole tool wherein the vanes divide the vane cavity into separate volumes.
15. The downhole tool wherein axial movement of the intermediate tubular body relative to the outer tubular body is restricted by the top and bottom end plates.
16. The downhole tool wherein rotational movement of the intermediately tubular body relative to the outer tubular body is limited by rotational movement of the vanes within the vane cavity.
17. The downhole tool wherein the inner tubular body comprises an outer seal to seal against the outer tubular body.
18. The downhole tool wherein the male splines are located adjacent to an upper end of the inner tubular body.
19. The downhole tool wherein the load nut acts as a piston adjacent an upper end of the inner tubular body.
20. The downhole tool wherein the load nut comprises a seal to seal against the outer tubular body.
21. The downhole tool wherein the inner tubular body comprises an extension that acts as a spring guide and a conduit for mud flow through the downhole tool.
22. The downhole tool further comprising a seal between the inner tubular body and the intermediate tubular body, wherein the seal can prevent direct flow of hydraulic fluid between upper and lower chambers of the downhole tool, and the seal can force hydraulic fluid between the upper and lower chambers to occur only via the vane cavity.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," "top", "bottom," and the like, may be used herein for ease of description to describe one element's or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated degrees or at other orientations) and the spatially relative descriptions used herein interpreted accordingly.

This written description uses examples to disclose the embodiments, including the best mode, and also to enable those of ordinary skill in the art to make and use the invention. The patentable scope is defined by the claims, and can include other examples that occur to those skilled in the art. Such other examples are intended to be within the scope of the claims if they have structural elements that do not differ from the literal language of the claims, or if they include equivalent structural elements with insubstantial differences from the literal languages of the claims.

In the foregoing specification, the concepts have been described with reference to specific embodiments. However, one of ordinary skill in the art appreciates that various modifications and changes can be made without departing from the scope of the invention as set forth in the claims below. Accordingly, the specification and figures are to be regarded in an illustrative rather than a restrictive sense, and all such modifications are intended to be included within the scope of invention.

It can be advantageous to set forth definitions of certain words and phrases used throughout this patent document. The term "communicate," as well as derivatives thereof, encompasses both direct and indirect communication. The terms "include" and "comprise," as well as derivatives thereof, mean inclusion without limitation. The term "or" is inclusive, meaning and/or. The phrase "associated with," as well as derivatives thereof, can mean to include, be included within, interconnect with, contain, be contained within, connect to or with, couple to or with, be communicable with, cooperate with, interleave, juxtapose, be proximate to, be bound to or with, have, have a property of, have a relationship to or with, or the like. The phrase "at least one of," when used with a list of items, means that different combinations of one or more of the listed items can be used, and only one item in the list can be needed. For example, "at least one of: A, B, and C" includes any of the following combinations: A, B, C, A and B, Aand C, B and C, and A and B and C.

Also, the use of "a" or "an" is employed to describe elements and components described herein. This is done merely for convenience and to give a general sense of the scope of the invention. This description should be read to include one or at least one and the singular also includes the plural unless it states otherwise.

The description in the present application should not be read as implying that any particular element, step, or function is an essential or critical element that must be included in the claim scope. The scope of patented subject matter is defined only by the allowed claims. Moreover, none of the claims invokes 35 U.S.C. § 112(f) with respect to any of the appended claims or claim elements unless the exact words "means for" or "step for" are explicitly used in the particular claim, followed by a participle phrase identifying a function.

Benefits, other advantages, and solutions to problems have been described above with regard to specific embodiments. However, the benefits, advantages, solutions to problems, and any feature(s) that can cause any benefit, advantage, or solution to occur or become more pronounced are not to be construed as a critical, required, sacrosanct or an essential feature of any or all the claims.

After reading the specification, skilled artisans will appreciate that certain features which are, for clarity, described herein in the context of separate embodiments, can also be provided in combination in a single embodiment. Conversely, various features that are, for brevity, described in the context of a single embodiment, can also be provided separately or in any sub-combination. Further, references to values stated in ranges include each and every value within that range.

We claim:

1. A downhole tool for a drill string with a drill bit in a hydrocarbon well, the downhole tool comprising:

an outer tubular body having an axis, a spring cavity with disc springs, longitudinal ribs, a vane cavity configured to receive and deliver hydraulic fluid flow;

an intermediate tubular body in the outer tubular body and comprising vanes located in the vane cavity of the outer tubular body, and female splines, and the vanes have a vane port;

an inner tubular body in the intermediate tubular body and comprising male splines that rotationally couple with the female splines and allow relative axial movement between the inner tubular body and the intermediate tubular body, wherein the male and female splines can rotate inside the outer tubular body for an angle determined by movement of the vanes between the longitudinal ribs in the outer tubular body; and wherein the inner tubular body has an extended position where it is pushed by the disc springs and, when weight is applied on the drill bit (WOB), the inner tubular body has a retracted position where it is pushed inward to compress the disc springs and push hydraulic fluid through the vane port on one side of the vanes in the vane cavity, which causes the inner tubular body and the intermediate tubular body to rotate for a selected angle relative to the outer tubular body.

2. The downhole tool of claim 1, wherein the outer tubular body further comprises a top end plate with a top port;

the inner tubular body comprises a load nut; and wherein rotational movement of the inner and intermediate tubular bodies also pushes hydraulic fluid from another side of the vanes through the top port to an upper chamber between the top end plate and the load nut.

3. The downhole tool of claim 2, wherein, when torque is applied on the drill bit, further rotational movement of the inner tubular body and the intermediate tubular body can occur, such that more hydraulic fluid is pumped to the upper chamber between the top end plate and the load nut, thereby moving the inner tubular body axially upward and further compressing the disc springs.

4. The downhole tool of claim 3, wherein decreasing WOB or torque on the drill bit causes the downhole tool to operate in an opposite direction.

5. The downhole tool of claim 2, further comprising a bottom end plate with a bottom port;

a stop ring mounted in the outer tubular body and located below the bottom end plate to limit upward axial movement of the inner tubular body; and the top and bottom ports provide hydraulic fluid flow to and from the vane cavity.

6. The downhole tool of claim 2, wherein downward travel of the inner tubular body is limited by the top end plate.

7. The downhole tool of claim 2, wherein axial movement of the intermediate tubular body relative to the outer tubular body is restricted by the top and bottom end plates.

8. The downhole tool of claim 2, wherein the load nut acts as a piston adjacent an upper end of the inner tubular body.

9. The downhole tool of claim 8, wherein the load nut comprises a seal to seal against the outer tubular body.

10. The downhole tool of claim 1, wherein the top end plate comprises a bypass port with a check valve and a return port wherein, when the return port is aligned with a port in the intermediate tubular body, the return port opens with a specific position of the vanes of the intermediate tubular body.

11. The downhole tool of claim 1, wherein the inner tubular body can move axially, without rotation, when only WOB is applied.

12. The downhole tool of claim 1, wherein the inner tubular body can rotate and move axially when torque is applied on the drill bit.

13. The downhole tool of claim 1, wherein the outer tubular body comprises a threaded connection adjacent to an upper end thereof to connect to a crossover sub to connect with an upper portion of the drill string.

14. The downhole tool of claim 13, wherein the inner tubular body comprises a connection for coupling to a lower portion of the drill string.

15. The downhole tool of claim 1, wherein the longitudinal ribs have rib seals that engage the intermediate tubular body.

16. The downhole tool of claim 1, wherein the vanes have vane seals that seal against the outer tubular body and the top and bottom end plates.

17. The downhole tool of claim 1, wherein the vanes divide the vane cavity into separate volumes.

18. The downhole tool of claim 1, wherein rotational movement of the intermediately tubular body relative to the outer tubular body is limited by rotational movement of the vanes within the vane cavity.

19. The downhole tool of claim 1, wherein the inner tubular body comprises an outer seal to seal against the outer tubular body.

20. The downhole tool of claim 1, wherein the male splines are located adjacent to an upper end of the inner tubular body.

21. The downhole tool of claim 1, wherein the inner tubular body comprises an extension that acts as a spring guide and a conduit for mud flow through the downhole tool.

22. The downhole tool of claim 1, further comprising a seal between the inner tubular body and the intermediate tubular body, wherein the seal can prevent direct flow of hydraulic fluid between upper and lower chambers of the downhole tool, and the seal can force hydraulic fluid between the upper and lower chambers to occur only via the vane cavity.

* * * * *